US011103335B2

(12) United States Patent
Beachy

(10) Patent No.: US 11,103,335 B2
(45) Date of Patent: Aug. 31, 2021

(54) APPARATUS FOR THE COLLECTION OF MAMMALIAN INSEMINATE

(71) Applicant: Bryan J. Beachy, Jefferson, OR (US)

(72) Inventor: Bryan J. Beachy, Jefferson, OR (US)

( * ) Notice: Subject to any disclaimer, the term of this patent is extended or adjusted under 35 U.S.C. 154(b) by 251 days.

(21) Appl. No.: 16/393,715

(22) Filed: Apr. 24, 2019

(65) Prior Publication Data

US 2020/0337820 A1 Oct. 29, 2020

(51) Int. Cl.
*A61D 19/02* (2006.01)

(52) U.S. Cl.
CPC ..... *A61D 19/021* (2013.01); *A61D 19/024* (2013.01); *A61D 19/027* (2013.01)

(58) Field of Classification Search
CPC ... A61D 19/021; A61D 19/027; A61D 19/024
See application file for complete search history.

(56) References Cited

U.S. PATENT DOCUMENTS

2002/0032419 A1* 3/2002 Barth ..... A61D 19/021 604/349
2010/0041944 A1* 2/2010 Levy ..... A61H 19/32 600/38
2019/0298505 A1* 10/2019 Eilts ..... A61D 19/021

* cited by examiner

*Primary Examiner* — Christine H Matthews
*Assistant Examiner* — Joshua Daryl D Lannu
(74) *Attorney, Agent, or Firm* — Chernoff Vilhauer LLP

(57) ABSTRACT

An apparatus for collecting seminal fluids, and specifically an artificial cervix for collecting seminal fluids for artificial insemination, is provided herein. The cervix comprises an elongated cylindrical member having either a closed end for receiving and storing ejaculated semen or an open end for allowing ejaculate to pass through, and an open end having a rim of a diameter sufficient to receive the penis of the animal. A handle can be detachably connected to the cylindrical member that allows users to hold the cervix in the correct position during collection of the animal's seminal fluids.

20 Claims, 5 Drawing Sheets

APPARATUS FOR THE COLLECTION OF MAMMALIAN INSEMINATE

BACKGROUND OF THE INVENTION

This invention relates to an apparatus for collecting mammal seminal fluids and, more particularly, relates to an artificial cervix for collecting semen from animals.

The most common method of collecting semen in animals is by the use of an artificial cervix. This usually consists of a stiff rubber tube having an interior rubber liner which leads to a rubber cone that is connected to a test tube for collecting the semen. The length of the vagina varies but should be long enough so that the penis penetrates completely, and ejaculation takes place directly into the cone and test tube. Prior to collection, the vagina is filled with warm water and lubricated internally with an innocuous lubricant such as paraffin or Vaseline. The internal temperature of the vagina should be about 45° C. to cover any heat loss prior to actual collection.

It is the usual practice to tease the animal prior to actual collection, and this consists of exciting the animal by allowing him to see and approach the teaser animal and even mounting but without ejaculation taking place. During the teasing, accessory fluid usually dribbles from the prepuce and the animal shows signs of erection. This separation is of considerable importance and unless it is carried out the collection is of poor quality.

The actual technique of collection is also important. It is advisable to apply the artificial cervix to the penis only when the animal is actually probing for it, and obviously prepared for service. It should not be applied as the animal is just mounting or in the process of dismounting, since quite apart from the unsatisfactory psychological effect on the animal, the semen quality and the volume of the ejaculate are inferior.

Great care must be exercised regarding the angle at which the vagina is held and collection taken. Some animals thrust violently against the hindquarters of the teaser, resulting in sharp bending of the penis and the resulting infliction of pain, which if repeated often enough, will inhibit the animal from further service.

The normal pattern of behavior of the animal is to approach the hindquarters of the teaser and nuzzle the base of the tail for a few seconds. The back is then depressed and there is a slight pumping action accompanied by erection and dribbling of accessory fluid. The animal then mounts, dropping his forelegs in front of the external iliacs of the teaser, and the penis begins to probe for the vagina.

At this point, the operator standing to the right of the animal clasps the sheath with his left hand, deflects the penis to one side, and at the same time holds the artificial cervix in his right hand so that entry of the penis takes place normally. The animal will thrust vigorously sometimes leaping off the ground in the process.

The prior art is replete with artificial cervixes that can be used as above described, for example, and as depicted in U.S. Pat. Nos. 2,441,868; 3,421,504; 3,631,853; 3,910,262; and 4,059,100. While these and other artificial cervixes have proved to be satisfactory for the collection of semen in animals, they suffer from the disadvantage of being too rigid during collection and lack the elasticity provided by the vagina of a living teaser during the actual thrust. Such rigidity and lack of elasticity results in a poor quality of collection as compared to the collection produced by a living vagina or an artificial cervix approaching the characteristics of a living vagina.

These disadvantages of the prior art, and especially the aforementioned U.S. patents, are overcome with the present invention, and commercially acceptable embodiments of an artificial cervix and the like are herein provided which are not only fully capable of collecting seminal materials under most operating conditions but which are also fully capable of other tasks completely beyond the capabilities of the devices of the prior art. More particularly, however, the embodiments of the present invention are capable of controlled operation with a much higher efficiency.

BRIEF SUMMARY OF THE PRESENT INVENTION

This invention is an apparatus for collecting seminal fluids, and specifically for an artificial cervix for collecting seminal fluids for artificial insemination. The cervix is formed from an elongated cylindrical member having a closed end for receiving and storing ejaculated semen, or an open end for allowing ejaculate to pass through, and an open end having a rim of a diameter sufficient to receive the penis of the animal. In one embodiment, a handle is detachably connected to said cylindrical member that allows users to hold the cervix in the correct position during collection of the animal's seminal fluids.

In one particularly ideal embodiment of the present invention, the artificial cervix is formed of a plurality of concentric and spaced-apart soft rubber rings or baffles within the cervix. The cervix is made from a semi-soft and flexible material to mimic the flexibility of the female mammal's cervix. The size and shape of the artificial cervix is such that it can encompass the male's penis while locally containing a synthetic or natural biochemical signature. The biochemical signature can be a chemical such as cervical mucus or the synthetic equivalent thereof.

The plurality of concentric baffles, or rings, within the artificial cervix are constructed so that the male's penis can penetrate and grip the cervix. The rings are designed to trigger the male's reflexes for optimal ejaculation.

A handle is provided that is used to grip the artificial cervix during collection efforts. The handle allows a user to hold the artificial cervix in the proper location so that the male mammal can ejaculate into the cervix and the ejaculate can be collected. The handle is made of a rigid material and is constructed to form a lock with the artificial cervix.

Accordingly, it is a feature of the present invention to provide method and apparatus for collecting seminal fluids and which includes an artificial cervix that provides a similar tactile sensation to the male as mating with a female.

It is another feature of the present invention to provide an artificial cervix that includes flexible baffles which can be moved in a reciprocating fashion with respect to the penis of the animal in order that the action of a teaser vagina may be produced by the artificial cervix.

It is a further feature of the present invention to provide an artificial cervix that moves in a reciprocating fashion on the penis of the animal, and which includes rings that are designed to trigger the male's reflexes for optimal ejaculation.

It is yet another feature of the present invention to provide an artificial cervix that massages the penis of the animal from which semen is to be collected in a fashion that is as natural as possible, that is easy to handle, controllable, and easy to collect from.

It is a still further feature of the present invention to provide an artificial cervix which is simple, durable, and which may be manufactured and sold at a reasonable cost.

It is also a feature of the present invention to provide an artificial cervix that will create an erect organ to more effectively produce seminal fluid in greater volume and quality than heretofore possible by more closely simulating the action of a live vagina of a teaser and without heavy reliance upon the physiological effect upon the animal by the teaser.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DETAILED DESCRIPTION OF PREFERRED EMBODIMENTS

Referring now to the attached Figures, there are shown embodiments of an apparatus for System for the Collection of Mammalian Inseminate.

Figure 1:
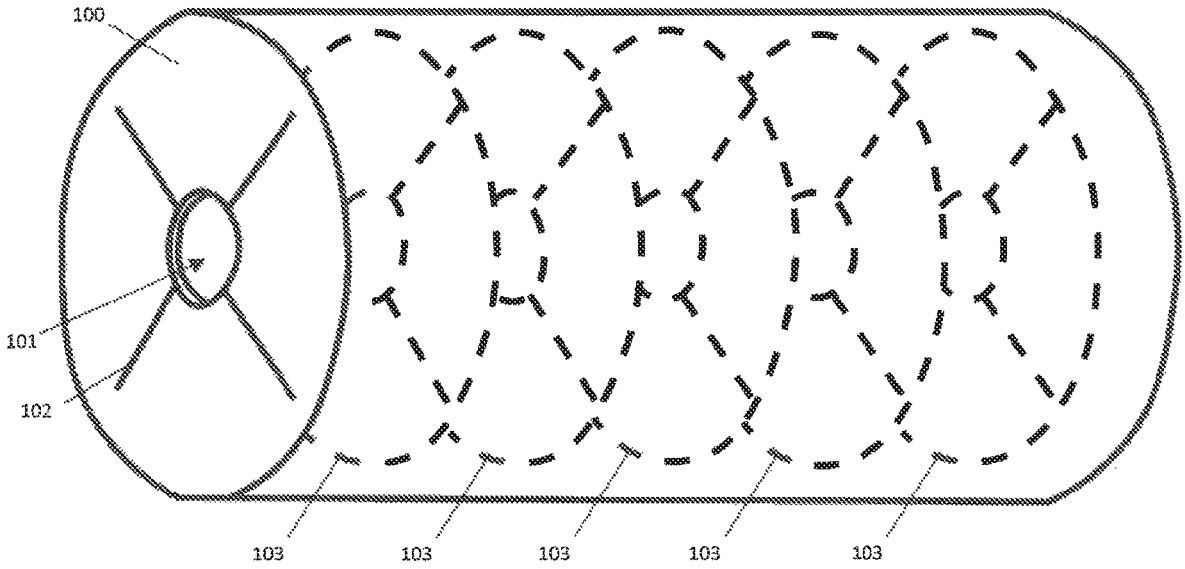
FIG. 1 is a view of an artificial cervix with a plurality of internal baffles as according to an embodiment of the present invention.
Figure 2:
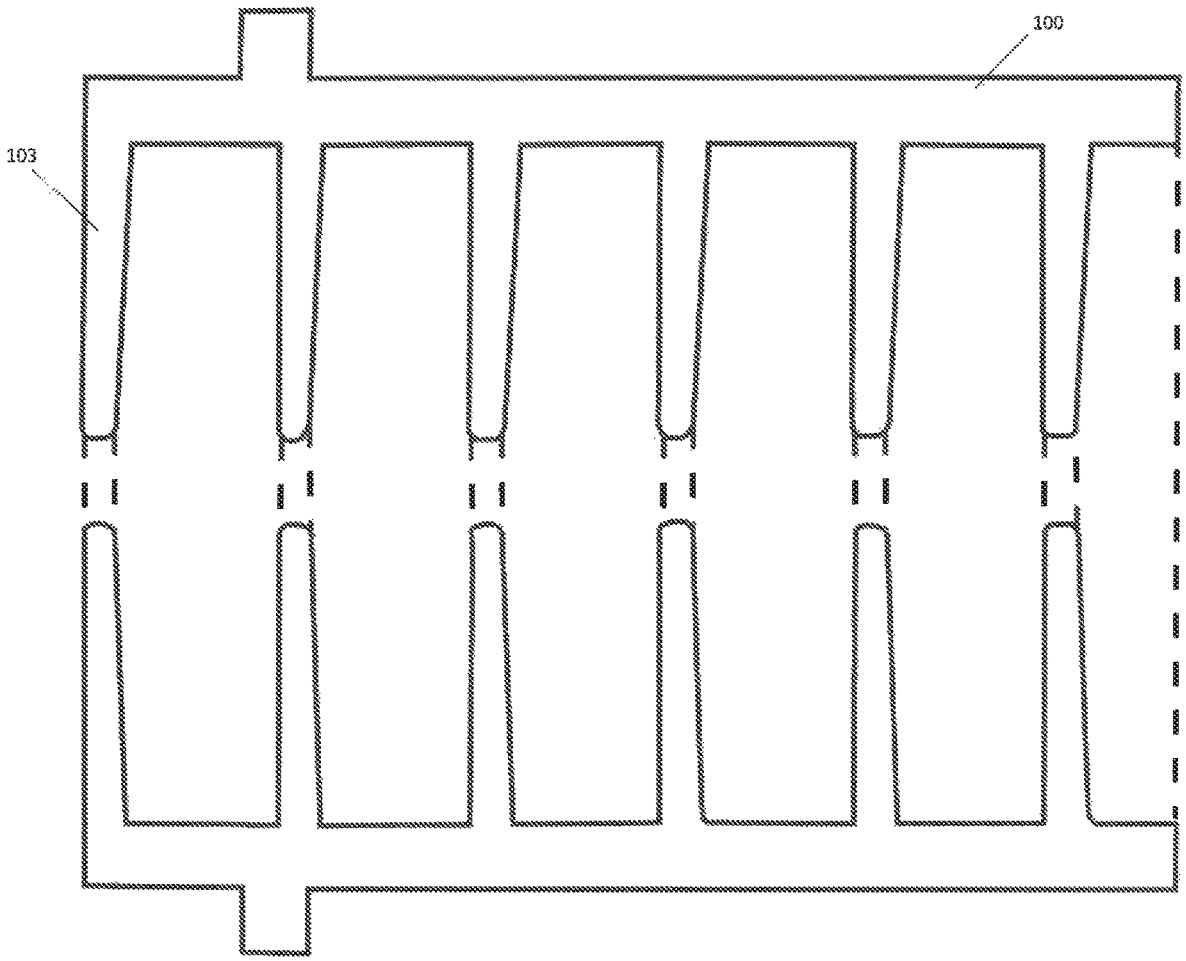
FIG. 2. is a detailed view of an artificial cervix with internal baffles as according to an embodiment of the present invention.

As illustrated in FIGS. 1 and 2, there is shown an artificial cervix (100) designed to be used for the collection of mammalian inseminate. The artificial cervix (100) comprises a cylindrical body that within has a plurality of semi-soft, flexible internal rings (103) positioned along the interior of the cylinder in a pattern for optimal sequencing of a male's trigger reflexes. The combination of the cylindrical housing and flexible internal rings (103) simulate a female mammal's cervix. The sequencing of the rings (103) is designed to promote optimal ejaculation by the male of the inseminate material. There is an opening (101) at an end of the artificial cervix (100) that allows a male's penis to penetrate the cervix (100). The present invention can accommodate species of variable size penises through the use of slits (102) on the opening (101) and each of the rings (103). The slits (102) allow portions of the opening (100) and rings (103) to deform or be pushed back when penises contact the ring (103). The amount of deformation or pushing back, or pulling forward as may ordinarily occur during mating movements by the male, of the ring (103) depends on which ring (103) is being contacted and the size of the penis. The larger the penis, the greater the deformation of the ring (103).

The rings (103), while being soft and flexible, are constructed so that the male's penis can grip the cervix. Gripping occurs by the penis encountering enough resistance from the rings (103) as would be found within the cervix of a female. Gripping further acts to trigger the male's ejaculatory reflexes.

In an embodiment of the present invention, an artificial cervix (103) has an opening (101) and five rings (103) to simulate the cervix of a ewe. The rings (103) are spaced in the cervix (103) in a pattern that stimulates the correct trigger reflexes and ejaculation of a ram. Post-ejaculation inseminate is collected from the cervix (103) or from collection vials as illustrated in additional Figures.

Figure 3:
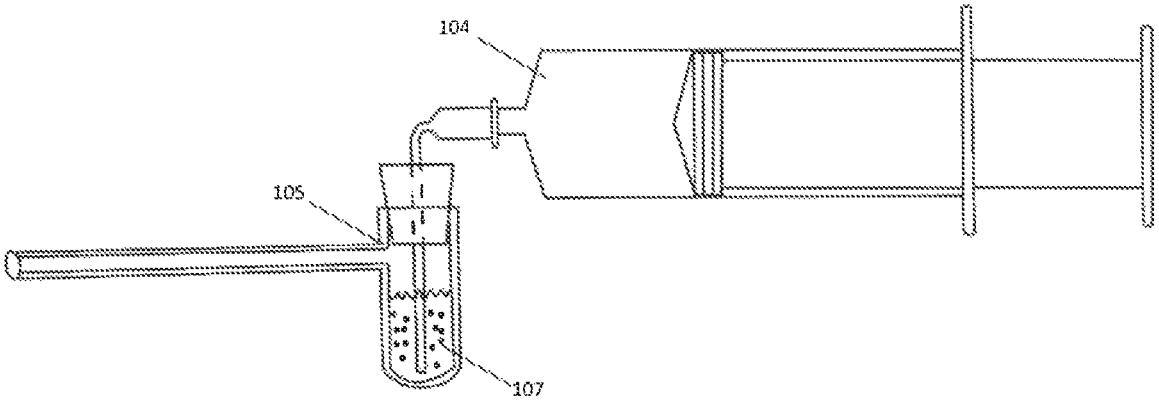
FIG. 3 is a view of a chemical signature injector for use with an artificial cervix as according to an embodiment of the present invention.

Regarding FIG. 3, there is shown a chemical signature injector for use with an artificial cervix. Artificial or naturally-occurring chemical signature (107) can be introduced into the artificial cervix (100) to further stimulate a male's ejaculation reflex. A chemical signature (107) can replicate the chemical communication between a male's penis and a female's cervix as would normally occur between a mating couple. The chemical signature (107) can be a natural or artificial chemical that replicates what is found within a female, such as a cervical mucus.

In an embodiment of the present invention, the chemical signature (107) is placed in the reservoir of an applicator (105). Air is injected into the chemical signature (107) by way of a syringe (104) with a tube or needle that is placed into the signature (107) in order to create bubbles within signature (107). The air injection of the signature (107) simulates the foamy or bubbly occurrence of certain types of signature (107) such as a ewe's naturally bubble cervical mucus. In an embodiment of the present invention, the needle or tube is 16-14 gauge. This size of the needle or tube ensures air enters the signature (107) at the proper pressure and volume. After air is injected from the syringe (104), the signature (107) leaves the applicator (105) through an applicator nozzle and travels into the artificial cervix (103). In an embodiment of the present invention the post air-injected signature (107) is applied to one or more of the rings (102) within the artificial cervix (103). In another embodiment of the present invention, the signature (107) is applied to all of the rings (102) within the artificial cervix (103).

Figure 4:
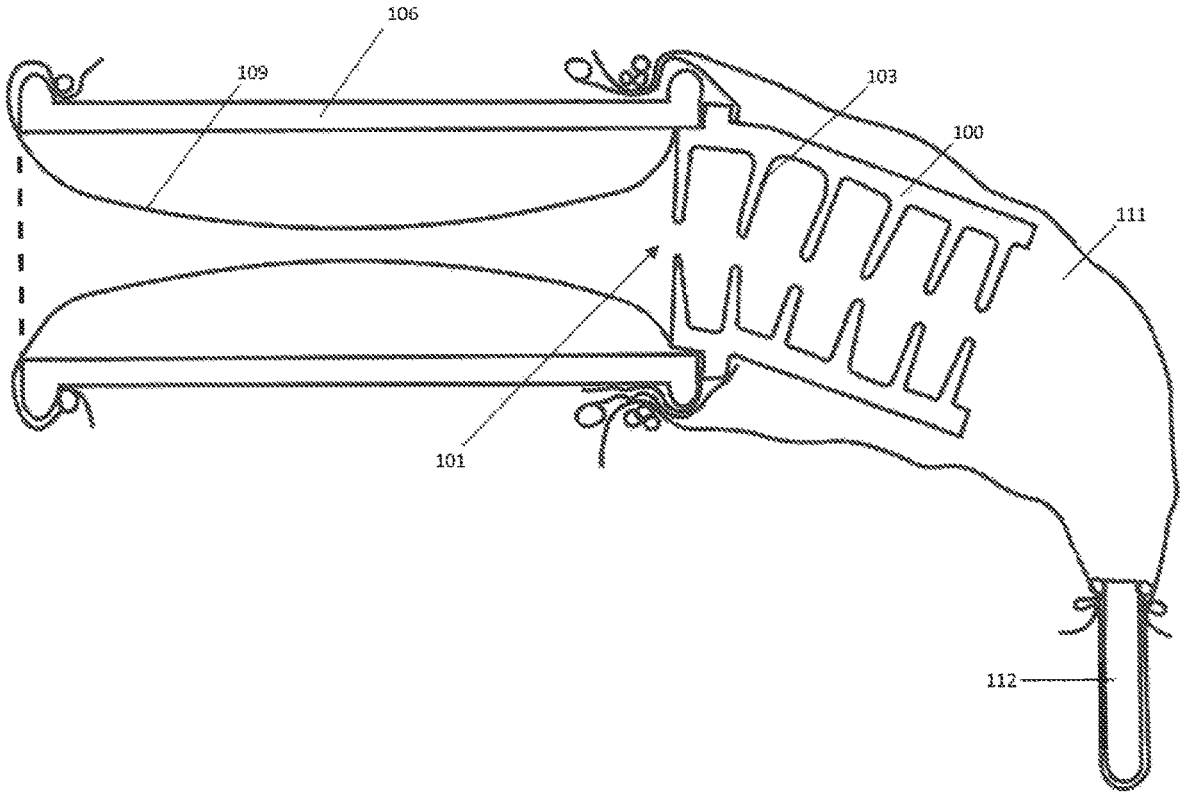
FIG. 4 is a view of an artificial vagina as found in the prior art combined with an angled artificial cervix contained within a collection device as according to an embodiment of the present invention.

Referring now to FIG. 4, there is shown an artificial vagina (106) as is commonly found within the prior art. The vagina (106) contains a liner (109) that contacts a male's penis. At an end of the artificial vagina (106) the artificial cervix (100) is connected so that the opening (101) of the artificial cervix (100) is in the proper position to receive a penis after it passes through the artificial vagina (106). In the illustrated embodiment the artificial cervix (100) is connected to the artificial vagina (106) at an angle that simulates the angle of a female's cervix relative to her vagina. The angling of the cervix (100) to the vagina enhances ejaculation of the male and assists with obtaining higher quality inseminate material.

It should be noted that in some embodiments of the present invention, the artificial cervix (100) is not angled relative to the artificial vagina (106). That is, the artificial cervix (100) is connected to the artificial vagina (106) in a linear fashion so that the opening in the artificial vagina (106) is in the same plane as a passageway through the artificial cervix (100) that runs through the openings of the rings (102) within the cervix (102).

Figure 5:
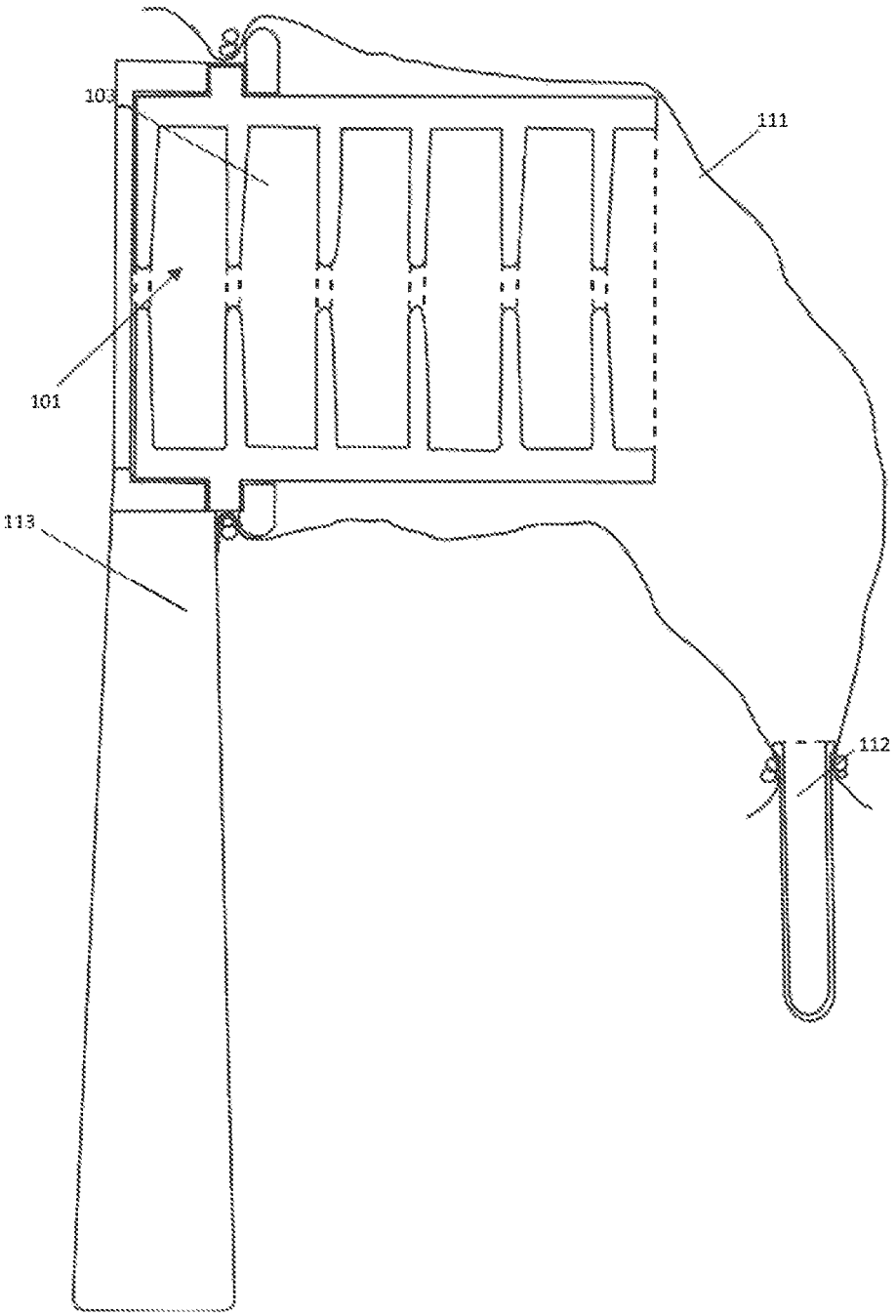
FIG. 5 is a view of a user-operable handle attached to an artificial cervix that is contained within a collection device as according to an embodiment of the present invention.

The artificial cervix (100) is open at the trailing end so that inseminate material can enter into a containment device (111) and finally collect in a vial (112) that is attached to the containment device (111). The containment device (111) can fully enclose the artificial cervix (100) as illustrated in FIGS. 4 and 5. However in other embodiments of the present invention the containment device (111) may be attached to an end of the artificial cervix (100). The containment device (111) can be a bag or sack that allows for collection and funneling of the inseminate material to the vial (112).

Referring now to FIG. 5, there is shown a user-operable handle (113) that is attached to an artificial cervix (100), the cervix (100) being located within a containment device (111) as according to an embodiment of the present invention. A vial (112) is attached to the end of the containment device (111) and located so that inseminate ultimately resides within the vial (112) after ejaculation. The handle (113) allows a user to position the artificial cervix (100) in an optimal location to collect the mammalian insemination material. In some embodiments, the present invention is used when a male is undergoing simulated mating activities. The male's penis is diverted into the artificial cervix (100) which is positioned in the correct location by a user that is holding the cervix (100) that is attached to the handle (113). Furthermore, the handle (113) is designed to be of sufficient length so that the user is not injured during collection attempts.

While the particular device for collection of mammalian inseminate as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

The detailed description, above, forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference. The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. An apparatus for collecting mammalian inseminate comprising:

a cylindrical housing within which are provided a plurality of flexible inner rings;

the inner rings being spaced along the interior of the cylindrical housing in a pattern that triggers a male's reflexes for optimal ejaculation;

the cylindrical housing having an opening designed to allow a penis of a male to enter the apparatus;

one or more of the plurality of flexible inner rings having one or more slits that allow a portion of each ring to deform when a penis contacts the ring; and either the cylindrical housing having a closed end that is designed to collect ejaculated inseminate material, or the cylindrical housing having an open end designed to allow ejaculated inseminate material to exit an artificial cervix.

2. The apparatus of claim 1 further comprising a handle that is attachable to an end of the cylindrical housing having the opening designed to allow the penis of the male to enter the apparatus.

3. The apparatus of claim 1 wherein the inner rings are constructed from a soft, deformable material.

4. The apparatus of claim 1 wherein the plurality of flexible rings includes five flexible inner rings.

5. The apparatus of claim 4 wherein a combination of the opening and the five flexible rings, when contacted by the male's penis, triggers the male's reflexes for optimal ejaculation.

6. The apparatus of claim 1 further comprising a chemical signature that is inserted into the cylindrical housing and is formulated to simulate a chemical communication that occurs between the penis of the male and cervix of a female of a species from which the inseminate is being collected.

7. An artificial cervix comprising:

a cylindrical housing;

an opening in an end of the cylindrical housing, the opening being designed to allow for entry of a male's penis;

a plurality of soft, deformable inner rings that contact the male's penis when the male's penis is received in the cylindrical housing;

the inner rings being located within the cylindrical housing;

the inner rings being arranged to trigger ejaculatory reflexes of the male;

the inner rings being constructed to provide sufficient resistance so that the male's penis can grip the artificial cervix;

the inner rings having a design that allows a portion of each of the inner rings to deform or fold away as the male's penis moves within the artificial cervix; and the cylindrical housing being constructed so that inseminate material is contained within the artificial cervix, or allowed to exit through the end of the cylindrical housing opposite the end through which the male's penis enters.

8. The artificial cervix of claim 7 wherein the inner rings are constructed from rubber.

9. The artificial cervix of claim 7 wherein each ring has one or more slits that allow for the deformation of a portion of the ring when contacted by the male's penis.

10. The artificial cervix of claim 9 wherein each ring has four slits.

11. The artificial cervix of claim 7 further comprising a handle that is attached to the end of the cylindrical housing containing the opening for the male's penis.

12. The artificial cervix of claim 11 wherein the handle is of sufficient length so that a user can hold the artificial cervix in a position to collect inseminate material during simulated mating activities of the male.

13. The artificial cervix of claim 9 wherein the artificial cervix is designed to hold a chemical signature.

14. The artificial cervix of claim 13 wherein the chemical signature is a chemical simulating the cervical mucus found in a cervix of a female.

15. A device for the collection of inseminate material of a mammal comprising:

a cylindrical housing containing a plurality of inner rings;

the plurality of inner rings being arranged in a pattern to trigger a male's reflexes for optimal ejaculation;

the pattern to trigger a male's reflexes for optimal ejaculation being a spacing of the rings within the cylindrical housing that approximates spacing of cervical rings within a female of a species' cervix;

an opening at one end of the cylindrical housing that allows for a penis of the male to enter the cylindrical housing;

openings within the inner rings being of sufficient size to simulate openings of the cervical rings of a female of a species; and the inner rings being constructed of a material that:

i. allow for deformation of each inner ring when contacted by the penis, and ii. provide sufficient resistance so the device can grip the male's penis.

16. The device of claim 15 wherein the cylindrical housing is designed to be used with an artificial vagina.

17. The device of claim 16 wherein the cylindrical housing is designed to attach to the artificial vagina at an angle that simulates an angle between a female's vagina and cervix.

18. The device of claim 16 wherein the cylindrical housing is designed to attach to the artificial vagina linearly with no angle between the cylindrical housing and the artificial vagina.

19. The device of claim 15 wherein the cylindrical housing is designed to attach to a containment device.

20. The device of claim 15 further comprising a chemical signature applicator.

* * * * *